United States Patent [19]

Nagai

[11] 3,984,976

[45] Oct. 12, 1976

[54] AIR-FUEL RATIO CONTROL SYSTEM FOR AUTOMOTIVE ENGINE WITH COMPENSATION CIRCUIT FOR DETERIORATION OF FEEDBACK SIGNAL GENERATOR

[75] Inventor: Tadashi Nagai, Yokosuka, Japan

[73] Assignee: Nissan Motor Co., Ltd., Japan

[22] Filed: June 13, 1975

[21] Appl. No.: 586,619

[30] Foreign Application Priority Data

June 17, 1974 Japan ..... 49-71103[U]

[52] U.S. Cl. ..... 60/274; 60/276; 60/285; 123/32 EA; 123/119 R

[51] Int. Cl.[2] ..... F02B 75/10

[58] Field of Search ..... 60/276, 274, 285; 123/119 R, 32 EA, 140 MC, 119 E; 204/195 S

[56] References Cited

UNITED STATES PATENTS

| | | | |
|---|---|---|---|
| 3,815,561 | 6/1974 | Seitz | 123/119 R |
| 3,903,853 | 9/1975 | Kizler | 123/119 R |

*Primary Examiner*—Douglas Hart
*Attorney, Agent, or Firm*—Robert E. Burns; Emmanuel J. Labato; Bruce L. Adams

[57] ABSTRACT

In a control system installed on a motor vehicle and constituted of an oxygen concentration sensor and a control device for regulating the fuel supply rate to apparatus for preparing an air-fuel mixture on the basis of a signal from the sensor, a compensation circuit is inserted between the sensor and the control device, a resistance in which circuit varies as the engine is run every predetermined hours or the vehicle travels every predetermined distance.

15 Claims, 6 Drawing Figures

AIR-FUEL RATIO CONTROL SYSTEM FOR AUTOMOTIVE ENGINE WITH COMPENSATION CIRCUIT FOR DETERIORATION OF FEEDBACK SIGNAL GENERATOR

This invention relates generally to a control system for controlling the air-fuel ratio of a combustible mixture fed to an internal combustion engine on the basic of a feedback signal representing a certain factor of the engine exhaust gas and more particularly to an improved control system having a circuit which compensate for variations in the level of the feedback signal resulting from prolonged use of an element for producing the signal.

For internal combustion engines working on a combustible mixture of air and fuel, particularly for those which are installed on vehicles, the need of regulating the air-fuel ratio of the combustible mixture exactly to a desired ratio is growing more and more not only to attain improved engine efficiencies but also to reduce concentrations of air pollutants in the exhaust gas. Nowadays the air-fuel ratio is usually controlled by means of an electronic control device which regulates a fuel supply rate to either a carburetor or a fuel injector attached to an induction passage.

It is known that the air-fuel ratio can be estimated from the concentration of a certain component of the exhaust gas such as oxygen, so that a sensor which produces an electrical signal representing the oxygen concentration in an ambient atmosphere is frequently disposed in the exhaust system of the engine to provide feedback to the aforementioned control device. Currently practicable oxygen concentration sensors are in principle almost exclusively of an oxygen concentration cell type, which cell is essentially made of a solid oxygen ion electrolyte such as $ZrO_2$, $TiO_2$ or CoO.

It is a general rule with an electrolyte to exhibit changes in its characteristics with the elapse of time or during prolonged use, and these solid electrolytes are not exceptional. In practice, this type of oxygen concentration sensor has a tendency of developing only a lessened magnitude of electromotive force when exposed to the exhaust gas for a long period of time. As a result, the control device receives a substantially inaccurate feedback signal and causes deviations of the air-fuel ratio from an initially intended ratio.

The present invention is concerned with a fundamentally known control system for controlling the air-fuel ratio of a combustible mixture fed to an internal combustion engine on a motor vehicle, which system is essentially constituted of a fuel supply means for supplying a fuel at a variable rate to the induction system of the engine, a sensor capable of developing an electrical signal representing the concentration of a component of the exhaust gas and a control device for the regulation of the fuel supply rate from the fuel supply means on the basis of the electrical signal from the sensor.

It is an object of the invention to provide an improved control system of the described type, in which variations in the level of the electrical signal from the sensor resulting from deterioration of the sensor during prolonged exposure thereof to the exhaust gas are automatically compensated.

According to the improvement of the invention, the control system is provided with a combination of a compensation means for compensating for variations in the level of the electrical signal from the sensor arranged between the sensor and the control device, and a shift means for gradually varying a characteristic value of the compensation means in correlation to total running hours of the engine such that variations in the characteristic value compensate for the variations in the level of the electrical signal.

The compensation means preferably have a ring-shaped variable resistor which is connected in series with the sensor, and the shift means preferably consist of a pair of stationary contacts and a total odometer, one of whose figure-indicating wheels carries thereon the ring-shaped variable resistor.

The invention will be fully understood from the following detailed description of a preferred embodiment thereof with reference to the accompanying drawings, in which.

Figure 1:
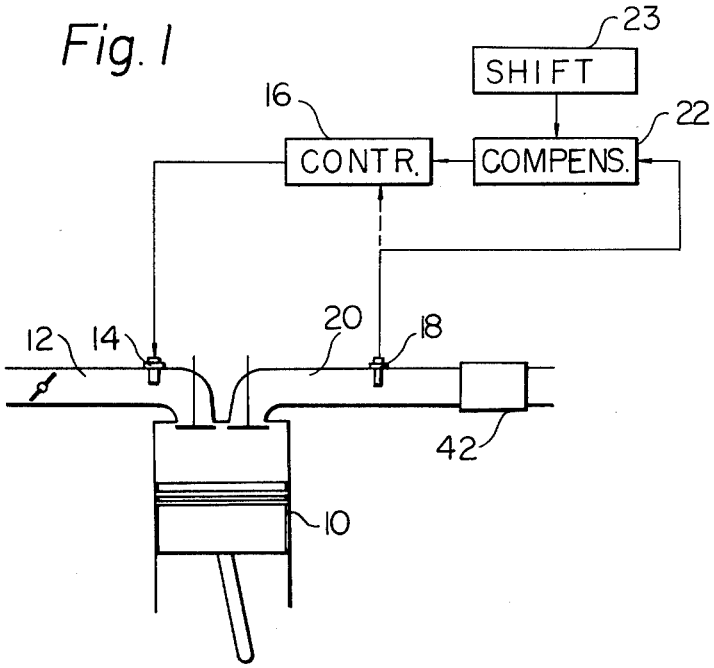
FIG. 1 is a fundamental block diagram showing an air-fuel ratio control system according to the invention.

FIG. 1 shows a system for controlling the air-fuel ratio of a combustible mixture which is fed to an internal combustion engine 10 through an air induction passage 12 equipped with a fuel injector 14. An electronic control device 16 regulates a fuel supply rate from the injector 14 so that the resulting combustible mixture may have an air-fuel ratio of an intended value. Thus the control device 16 is a vital element of this air-fuel ratio control system, but a device of such a function is now so familiar to those who are skilled in the art of internal combustion engines that no explanation of its construction will be needed. It is a usual practice for this control system to establish a feedback loop by detecting a certain factor of the engine exhaust gas which is correlated to the air-fuel ratio of the combustible mixture and feeding an electrical signal representing the values of the detected factor into the control device 16. The oxygen concentration in the exhaust gas serves as such a factor. In the system of FIG. 1, an oxygen concentration sensor 18, e.g., of a stabilized zirconia ($ZrO_2$) cell type, is attached to an exhaust pipe 20 of the engine 10 and exposed to the exhaust gas flowing therein. In conventional control sytems, the output of the sensor 18 is fed substantially directly to the control device 16 as indicated by a dotted line in FIG. 1.

Figure 2:
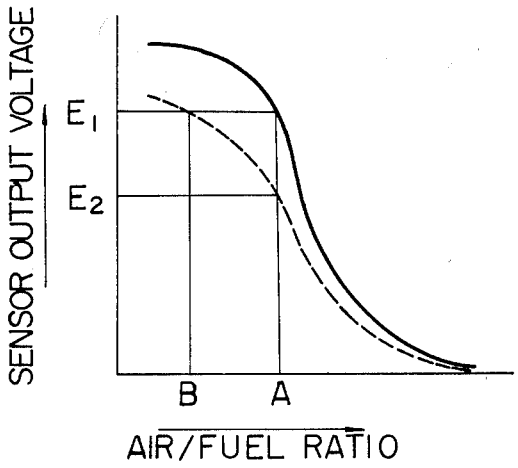
FIG. 2 is a graph showing generally the relationship between the air-fuel ratio of a combustible mixture fed to an engine and the output voltage of an oxygen concentration sensor exposed to the exhaust gas of the engine.

When the air-fuel ratio of the combustible mixture is varied around a stoichiometric ratio, the resulting changes in the oxygen concentration in the exhaust gas cause the output voltage of the sensor 18 to vary in a manner generally as represented by the curve of a solid line in the graph of FIG. 2. If it is intended to regulate the air-fuel ratio to a value A, the control device 16 is preliminarily adjusted so as to realize a fuel supply rate corresponding to the ratio A when the input signal thereto from the sensor 18 is of a level corresponding to an output voltage $E_1$ of the sensor 18. If the output voltage becomes higher than $E_1$, the control device 16 causes the fuel supply rate to be lowered until the output voltage falls to $E_1$, and vice versa.

Thus the air-fuel ratio can be minutely controlled by the closed loop control system essentially made up of the control device 16, fuel injector 14 and the oxygen sensor 18. In practical applications, however, the sensor 18 exhibits inevitable changes in its output characteristic with the elapse of time if the sensor 18 is exposed to the exhaust gas for a prolonged period of time. For example, the output characteristic curve of FIG. 2 shifts to another curve represented by a dotted line when the sensor 18 is used for a certain time. Accordingly the output voltage falls to $E_2$ when the air-fuel ratio is kept at A, and the control device 16 causes the fuel injector 14 to supply much more fuel to the induction passage 12 until the output voltage of the sensor 18 increases to $E_1$. As a result, the air-fuel ratio is varied to a ratio B which is comparatively smaller than the intended ratio A.

To minimize such unintentional and unfavorable deviation of the air-fuel ratio from the intended ratio, the present invention proposes to feed the output of the sensor 18 to the control device 16 not directly as in the prior art systems but through a compensation device 22 as shown by a solid line in FIG. 1. In accordance with the invention, the compensation device 22 is associated with a shift means 23 which causes a selected characteristic value of the compensation device 22 to vary gradually. The function of the shift means is correlated to total running hours of the engine 10. The rate of the characteristic value variation with respect to the engine running hours is preliminary determined so as to be nearly in compliance with the decreasing rate of the output voltage of the sensor 18.

Figure 4:
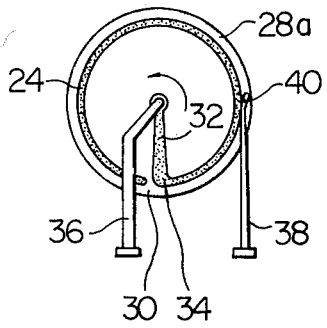
FIG. 4 is a front view of the same combination.
Figure 3:
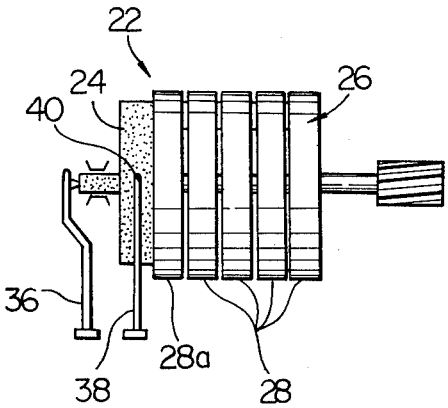
FIG. 3 is a side elevation of a portion of an odometer which is combined with a variable resistor as a first preferred embodiment of the invention.

A first preferred embodiment of the compensation device 22 according to the invention will be explained hereinafter with reference to FIGS. 3 and 4. In this embodiment a variable register 24 is employed as the compensation device 22, and its effective resistance is varied as the total distance travelled by the vehicle increases. A total odometer 26, which registers and indicates the total distance travelled by the vehicle and is installed on most motor vehicles, is employed in this embodiment as the shift means 23 to vary the resistance of the variable resistor 24. The odometer 26 has a plurality of figure-indicating drums or wheels 28, on each periphery are ten figures 0–9, so as to indicate numbers of usually five or six figures. The variable resistor 24 is shaped generally ring-like and fixed coaxially to an extreme left wheel 28*a* of the odometer 26 which represents ten thousandth place and hence makes one-tenth a revolution every 10,000 km (or miles) travel distances. The ring shaped resistor 24 has a narrow and axial slit 30 on its periphery and a radial extension 32 which starts from an edge 34 bordering the slit 30 and terminates at the center of the ring. The extension 32 may alternatively be a fixed lead or contact plate. A stationary first contact plate 36 is arranged so as to keep contact with the extending end of the extension 32 of the resistor 24 and is connected with the control device 16. A stationary second contact plate 38 is arranged so as to be in contact with the periphery of the resistor 24 and is connected with the sensor 18. The second contact plate 38 makes a slide along the periphery of the resistor 24 when the latter rotates on its axis. The resistor 24 is arranged in such a manner that the circumferential distance between the edge 34 and a contact point 40 with the second contact plate 38 is initially nearly equal to the full circumference of the resistor 24 and gets shorter as the resistor 24 rotates together with the wheel 28*a*. The control device 16 is adjusted taking into consideration that the output of the sensor 18 is fed to the control device 16 at a modulated magnitude when the compensation device 22 is employed.

Figure 5:
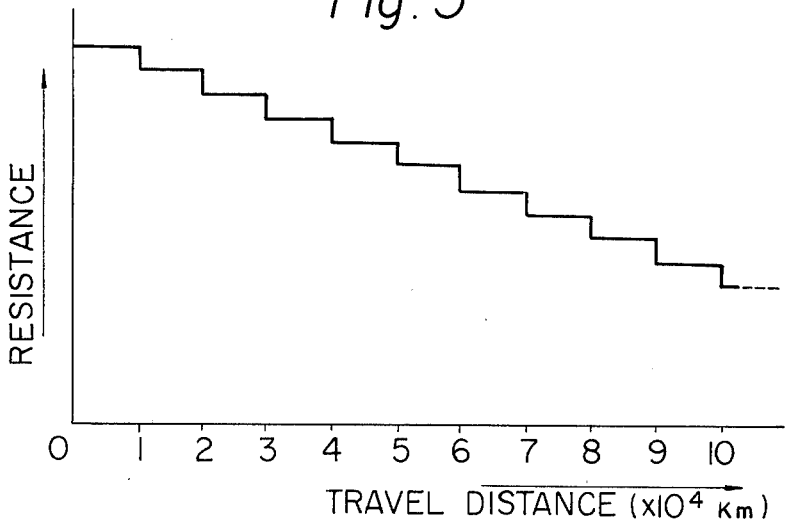
FIG. 5 is a graph showing an example of the modes of variations in the resistance of the resistor of FIGS. 3 and 4 with increase in the distance travelled by a vehicle which carries the system of FIG. 1.

When the total distance travelled by the vehicle reaches a 10 thousand km and accordingly the output voltage of the sensor 18 drops from the initial level by a certain magnitude, the wheel 28*a* of the odometer 26 makes one-tenth a revolution and causes the resistor 24 to make the same revolution. Accordingly the resistance between the first and second contact plates 36 and 38 decreases gradually or stepwise as the travel distance increases as shown in FIG. 5. The decrease in the effective resistance of the resistor 24 compensates for the drop of the output voltage of the sensor 18, so that the level of the oxygen concentration signal at the input gate of the control device 16 can be maintained almost unchanged even though the sensor 18 exhibits gradual deterioration with the elapse of time. Thus the air-fuel ratio of the combustible mixture can be exactly regulated to intended values throughout a prolonged operation of the engine 10.

The compensation for the deterioration of the sensor 18 may alternatively be attained by the use of an integrating timer (not shown) which registers the total running time of the engine 10, e.g., by totalizing the duration of high voltage pulses for the ignition of the engine 10. The timer is combined with either a variable resistor 24, which might be differently shaped from the resistor 24 of FIG. 1, or a plurality of resistors arranged in parallel with each other and interchangeably such that the resistance between the sensor 18 and the control device 16 is decreased, e.g., every 100 hr of the total pulse duration.

When the exhaust pipe 20 is connected with a reactor 42 containing therein a catalyst (not shown) for the reduction of nitrogen oxides and/or for the oxidation of carbon monoxide and unburned hydrocarbons, the catalytic action of the catlyst depends at least partly on the air-fuel ratio of the combustible mixture. Such a catalyst also exhibits certain changes in the strength of its catalytic action with the elapse of time, and an optimum air-fuel ratio of the combustible mixture for the catalytic action (usually around a stoichiometric ratio) shifts to smaller values. To minimize the lowering of the catalytic action of the catalyst, the variable resistor 24 for use in a vehicle having such a reactor 42 is constructed and shaped such that the level of the input signal to the control device 16 is varied in accordance with the deterioration rate of the catalyst as the total travel distance of the vehicle increases. More particularly, the effective resistance of the variable resistor 24 is not decreased by a constant value per a predetermined travel distance as shown in FIG. 5, but the decrease rate is lowered, when it is desirable to lower the air-fuel ratio gradually, as the total travel distance increases.

Figure 6:
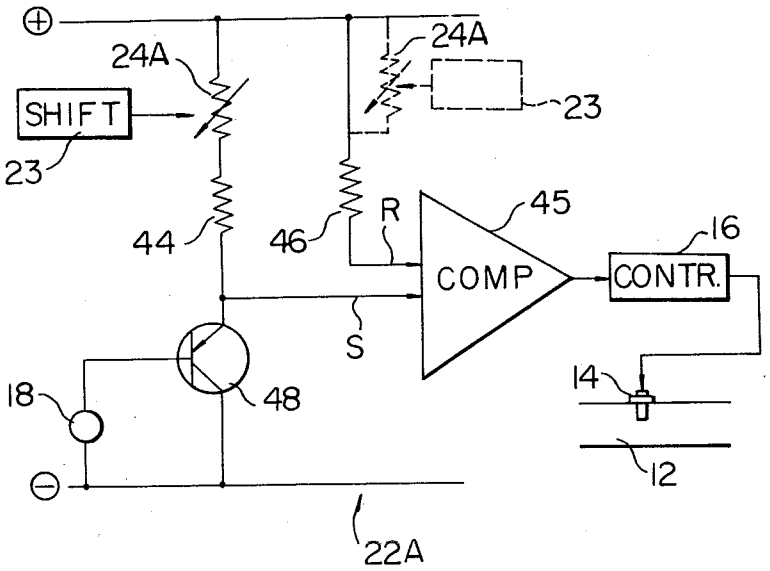
FIG. 6 is a block diagram showing a second preferred arrangement of a compensation means in the air-fuel ratio control system in accordance with the invention.

FIG. 6 shows another preferred embodiment of the invention. In this instance the output signal from the oxygen sensor 18 is not directly fed to the control device 16 but changed into a different type of signal in a compensation circuit 22A. This circuit 22A has a comparator 45 which compares the potential of a signal S correlated to the oxygen concentration in the exhaust gas with the potential of a reference signal R and supplies a signal C representing the result of the comparison to the control device 16. As seen in FIG. 6, the potential of the signal S is principally determined by the resistance of a first resistor 44 while the potential of the reference signal R is determined by a second resistor 46. This circuit 22A, however, further includes a transistor 48 arranged such that the signal S is applied to the emitter of the transistor 48 in parallel with he comparator 45. The output voltage of the sensor 18 is utilized as a base bias for this transistor 48.

When the air-fuel ratio of a combustible mixture prepared by the operation of the fuel injector 14 is relatively low and accordingly the oxygen sensor 18 gives a relatively high output, no or only a limited amount of current flows from the emitter to the collector of the transistor 48. Therefore, there is no or only a little difference between the potentials of the two signals S and R at the input gates of the comparator 45 if the two resistors 44 and 46 have the same resistance value. When the air-fuel ratio increases and the output of the sensor 18 lowers, an increased amount of current flows from the emitter to the collector, resulting in drop of the potential of the signal S applied to the comparator 45. Thus the potential of the signal S is correlated to the oxygen concentration in the exhaust gas.

For this circuit 22A, deterioration of the sensor 18 means drop of the base bias voltage for the transistor 48 and results in lowering of the potential of the signal S even if the oxygen concentration in the exhaust gas remains unchanged. To compensate for such drop of the output voltage of the sensor 18, the first resistor 44 is either replaced by or connected in series with a variable resistor 24A, the resistance of which is varied by the action of the shift means 23, e.g., the total odometer 26. The resistance is gradually decreased as the distance travelled by the vehicle or the total engine running time increase as hereinbefore explained referring to FIG. 5. Alternatively, the second resistor 46 may be either replaced by or connected in series with the variable resistor 24A as illustrated by dotted lines in FIG. 6. In this case the resistance of the variable resistor 24A is gradually increased by the action of the shift means 23 so that the potential of the reference signal R may lower gradually and compensate for the aforementioned drop of the potential of the signal S. The resistance of the variable resistor 24A is usually increased on a pattern similar to the graph of FIG. 5 except that the graph is ascending stepwise.

In the foregoing description of the preferred embodiments, apparatus for preparing a combustible mixture for the engine 10 was exemplified solely by the fuel injector 14 attached to the induction passage 12. It will be understood, however, that the present invention is applicable also to a control system having a carburetor the air-fuel mixing ratio in which is controlled electronically.

As an alternative to the compensation device 22 which modulates the output of the sensor 18, the control device 16 may be provided with a circuit (not shown) which can alter the response characteristic of the control device 16 to the oxygen concentration signal gradually.

The provision of the compensation device 22 according to the invention can be applicable also to a fundamentally similar control system, in which a non-dispersed infrared gas analyzer is employed to detect the concentration of, e.g., carbon monoxide (which also is correlated to the air-fuel ratio of the combustible mixture) in the exhaust gas in place of the oxygen concentration sensor 18.

What is claimed is:

1. In a system for controlling the air-fuel ratio of a combustible mixture fed to an internal combustion engine carried on a motor vehicle, the system having a fuel supply means for supplying a fuel at a variable rate to a means for preparing a combustible mixture of air and fuel, a sensor which is exposed to the exhaust gas of the engine and develops an electrical signal representing the concentration of a component of the exhaust gas, the concentration being correlated to the air-fuel ratio of the combustible mixture, and a control means for regulating the fuel supply rate from the fuel supply means on the basis of the electrical signal fed thereto from the sensor, the improvement comprising a compensation means for compensating for variations in the level of said electrical signal arranged between said sensor and said control means and a shift means for gradually varying a characteristic value of said compensation means in correlation to total running hours of said engine and at such a rate that variations in said characteristic value compensate for variations in the level of said electrical signal caused by a prolonged exposure of said sensor to the exhaust gas.

2. The improvement as claimed in claim 1, wherein said compensation means have a variable resistor connected in series with said sensor and said control means, said characteristic value being an effective resistance of said variable resistor.

3. The improvement as claimed in claim 2, wherein said variable resistor has a ring-shaped resistance element with an axially arranged slit and a terminal placed on the axis of the ring and connected to said resistance element, said shift means being constituted of a total odometer having a plurality of figure-indicating wheels and a pair of stationary contact members, one of said contact members being in contact with said terminal and the other being slidably in contact with the periphery of said ring-shaped resistance element, said resistance element being fixed coaxially to one of said figure-indicating wheels.

4. The improvmenet as claimed in claim 3, wherein said resistance element is arranged such that said effective resistance decreases as said one figure-indicating wheel revolves.

5. The improvement as claimed in claim 2, further comprising a catalytic reactor containing therein a catalyst for converting harmful substances contained in the exhaust gas to harmless substances before emission into the atmosphere, the catalytic action of said catalyst depending on the air-fuel ratio of the combustible mixture, the relationship between said catalytic action and said air-fuel ratio varying during a prolonged exposure of said catalyst to the exhaust gas, said effective resistance of said variable resistor being varied such that variations in the level of said electrical signal is compensated in inexact accordance with the variations in the level of said electrical signal thereby to allow said air-fuel ratio to vary generally in accordance with variations in said relationship.

6. The improvement as claimed in claim 5, wherein said effective resistance is decreased gradually, the rate of decrease lowering as total running hours of said engine increase.

7. The improvement as claimed in claim 2, wherein said shift means have an integrating timer means for registering total running hours of the engine by totalizing the durations of high voltage pulses produced for the ignition of the engine.

8. The improvement as claimed in claim 1, wherein said compensation means are constituted of means for developing a first potential, means for developing a second potential, a comparator arranged to compare the magnitude of said first potential with the magnitude of said second potential and supply a signal representing the result of the comparison to said control means, a transistor arranged such that said first potential is applied to the emitter thereof in parallel with said comparator and that said electrical signal from said sensor is applied to said transistor as a base bias potential, and a variable resistor combined with one of said first and second means and associated with said shift means.

9. The improvement as claimed in claim 8, wherein said variable resistor is combined with said first means and arranged such that an effective resistance thereof is gradually decreased by said shift means.

10. The improvement as claimed in claim 8, wherein said variable resistor is combined with said second means and arranged such that an effective resistance thereof is gradually increased by said shift means.

11. A method of compensating for variations in the level of an electrical signal supplied from a sensor exposed to an exhaust gas from an internal combustion engine of a motor vehicle to a control means for controlling the air-fuel ratio of a combustible mixture fed to the engine, said electrical signal representing the concentration of a component of the exhaust gas, said concentration being correlated to the air-fuel ratio, said variations being caused by a prolonged exposure of said sensor to the exhaust gas, the method comprising the steps of passing said electrical signal through a variable resistor prior to arrival at said control means, and varying the resistance of said variable resistor as total running hours of the engine increase.

12. A method as claimed in claim 11, wherein said resistance is decreased at a variable rate, said variable rate lowering as said total running hours increase.

13. A method of compensating for variations in the level of an electrical signal supplied from a sensor exposed to an exhaust gas from an internal combustion engine of a motor vehicle to a transistor as a base bias potential, said electrical signal representing the concentration of a component of the exhaust gas, said concentration being correlated to the air-fuel ratio, said variation being caused by a prolonged exposure of said sensor to the exhaust gas, said transistor being connected to a control circuit for controlling the air-fuel ratio of a combustible mixture fed to the engine such that the potential of a control signal for comparison with the potential of a reference signal depends on said base bias potential, the method comprising the step of varying the potential of one of said control signal and reference signal by varying a resistance for producing said potential of said one signal as total running hours of the engine increase.

14. A method as claimed in claim 13, wherein said one signal is said control signal, said resistance being decreased as said total running hours increase.

15. A method as claimed in claim 13, wherein said one signal is said reference signal, said resistance being increased as said total running hours increase.

* * * * *